United States Patent [19]

Gazda et al.

[11] 4,035,011

[45] July 12, 1977

[54] SOFT SET RUNNING TOOL

[75] Inventors: Imre I. Gazda, Saginaw; Joseph L. Pearce, Dallas, both of Tex.

[73] Assignee: Otis Engineering Corporation, Dallas, Tex.

[21] Appl. No.: 647,341

[22] Filed: Jan. 8, 1976

[51] Int. Cl.[2] ..... E21B 31/02

[52] U.S. Cl. ..... 294/86.18; 166/125

[58] Field of Search ..... 296/86.1, 86.19, 86.18, 296/86.17, 86.31, 86.33, 86.2, 86.28, 86.29, 86.03, 102 A, 102 R; 166/315, 123, 125, 181, 98

[56] References Cited

U.S. PATENT DOCUMENTS

| | | | |
|---|---|---|---|
| 3,136,366 | 6/1964 | Brown et al. | 166/125 |
| 3,874,447 | 4/1975 | McGowen, Jr. | 294/86.18 |
| 3,942,833 | 3/1976 | Plunk | 294/86.18 |

*Primary Examiner*—James B. Marbert

*Attorney, Agent, or Firm*—Warren H. Kintzinger

[57] ABSTRACT

A well running tool used for lowering and setting well bomb hangers and various tool string hangers in a well and then disengagement for removal from the well, leaving the hanger set in place in the well. It is a soft set running tool designed to disengage from a bomb hanger, or other well tool hanger, with an upward pulling force substantially greater than the weight of the bomb hanger or other tool hanger, being positioned in the well after the hanger is key lock set in place down the well.

17 Claims, 9 Drawing Figures

SOFT SET RUNNING TOOL

Figure 1:
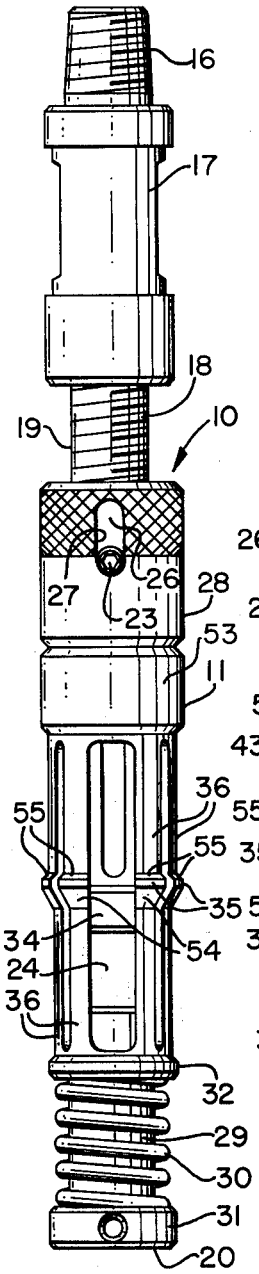

This invention relates in general to well tubing running tools, and in particular to an improved soft set running tool capable of lowering and setting well bomb hangers and being disengaged from a set bomb hanger without jerking or jarring of the bombhanger.

In wells drilled for the recovery of oil and/or gas various running tools are used for positioning various well tools or tool string hangers in well tubing and then the running tool is released for removal with the wireline for use elsewhere, leaving the well tool or tool string hanger mounted in place down the well. One existing running tool has a core, a collet and an outer sleeve. The collet acts to hold the dog carrier in an up position while the tool is being run, and mandrels of the tool are held in running position by two tangential brass shear pins. Then after the assembly has been run and landed in a nipple, jarring down acts to release the collet within the running tool and allows the dogs to fall free. Upward jarring is then used in setting the mandrel and releasing the running tool from the assembly.

With another running tool a subsurface control device is held in place on the running tool by shear pin structure inserted through horizontal tangential grooves, and after the lowered control device is locked in place in a landing nipple the shear pin structure is sheared by upward jarring action. This releases the running tool for withdrawal up the well tube.

An alternate type running tool uses spring-actuated dogs that grasp the upper flange of the slip carrier on the mandrel assembly, and a shear pin is the means for release of the running tool after the slips are set and the mandrel assembly is locked in the tubing. Jarring down with the wireline tools acts to force the slips on the mandrel assembly to firmly engage the tubing walls and shears the shear pin inside the running tool. Then additional downward jarring acts to move the running tool cylinder down with respect to the body and causes the running tool to lock in its released state for upward removal from the well.

With still another running tool using a shear pin to hold the collet in the running position, upward jarring is used to set the mandrel in locked position and expand a packoff element. Then further jarring is used to shear the shear pin in the running tool for release from the position set mandrel and withdrawal from the well hole tubing.

Thus jarring is employed with many existing well running tools in order to achieve shear pin-shearing separation release of running tools from tools and equipment positioned down a well, and in some cases to position set lock tools in the well. Jarring forces imposed on tools and equipment may be tolerated in many instances. There are, however, many cases where shock forces are destructive of sensitive measuring equipment and/or distort delicate calibration settings with, for example, pressure and/or temperature measuring equipment and with timing watch work like equipment used therewith in bomb hanger suspended equipment.

It is therefore a principal object of this invention to achieve position setting of sensitive tools and equipment in a well without destructive damaging shock being transmitted to the tools and equipment.

Another object is to provide a well running tool capable of achieving such soft set position setting of sensitive tools and equipment in a well.

A further object is to provide a well running tool structure capable of separation release from tools and equipment position set down well tubing without use of jarring such as required with running tools having shear pins.

Features of this invention useful in accomplishing the above objects include, in a soft set running tool, a running tool suspended by wire line having a collet interconnect with the fishing neck of a tool hanger. The collet is normally locked in engagement containment within the tool hanger fishing neck by a backing retainer member of the soft set running tool. This locked state is maintained until, with the tool hanger position set in place in well tubing, upward pulling force exerted through the wire line withdraws a collet locking retainer ring from collet lock backing position alignment, with force enough greater than the weight of tool hanger and the equipment mounted thereby to compress a spring in the soft set running tool. Thereafter, with sufficient upward pulling force being exerted through the wire line to cam locking projections on collet member spring arms inward to the unlocked state, the running tool is disengaged from the fishing neck of the tool hanger that remains positioned in well tubing as the wire line and running tool are removed from the well. The soft set running tool is also equipped with a set screw release and threaded retainer member mount, for threaded displacement of the retainer member collet locking retainer ring from locking position alignment, to facilitate insertion assembly of the running tool into the collet receiving fishing neck section of a tool hanger to be run.

A specific embodiment representing what is presently regarded as the best mode for carrying out the invention is illustrated in the accompanying drawings.

Figure 2:
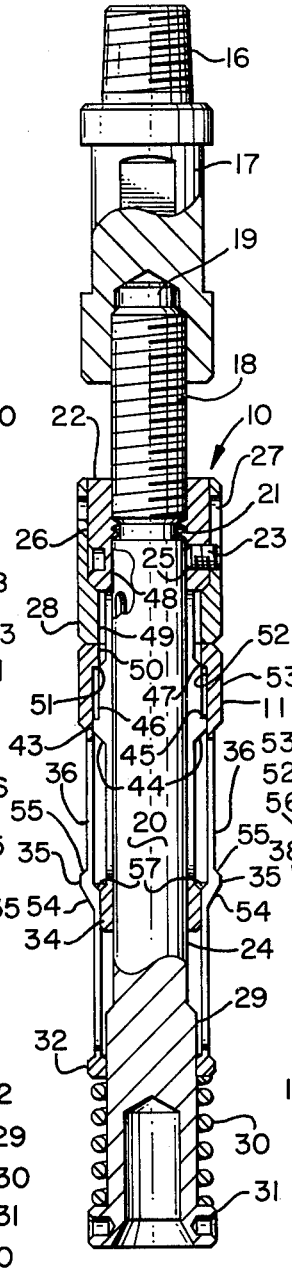
Figure 3:
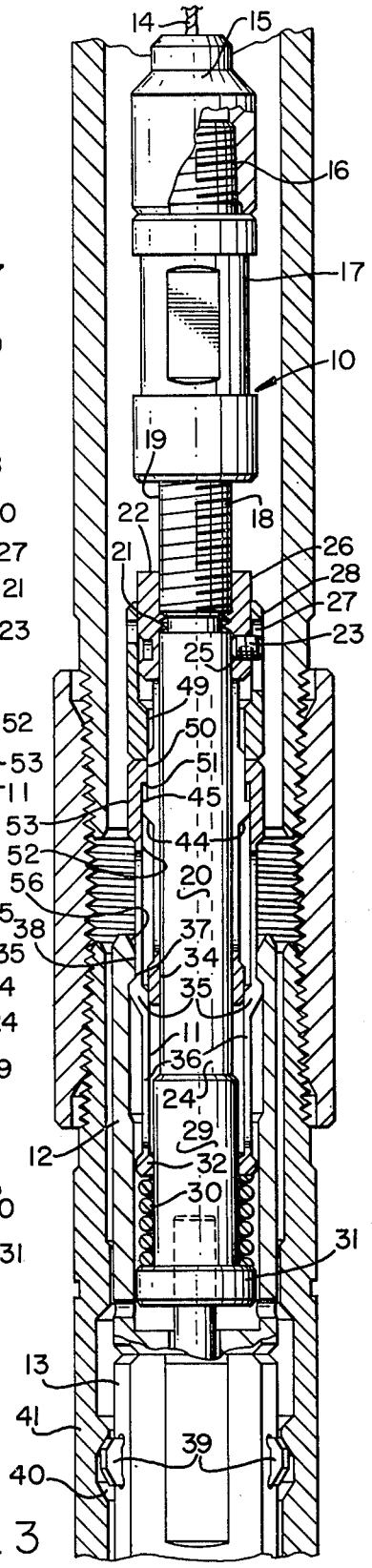
Figure 4:
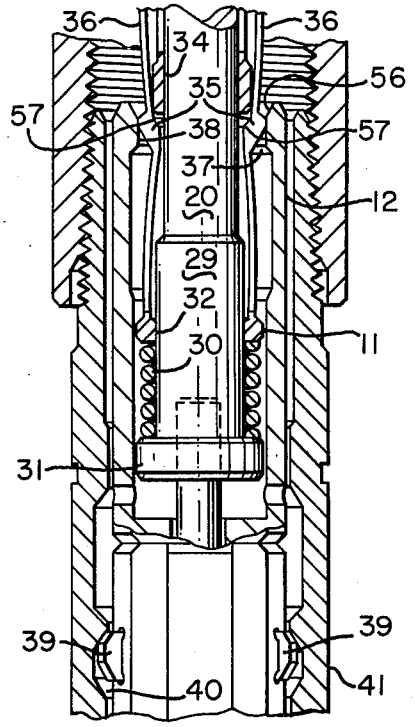
Figure 5:
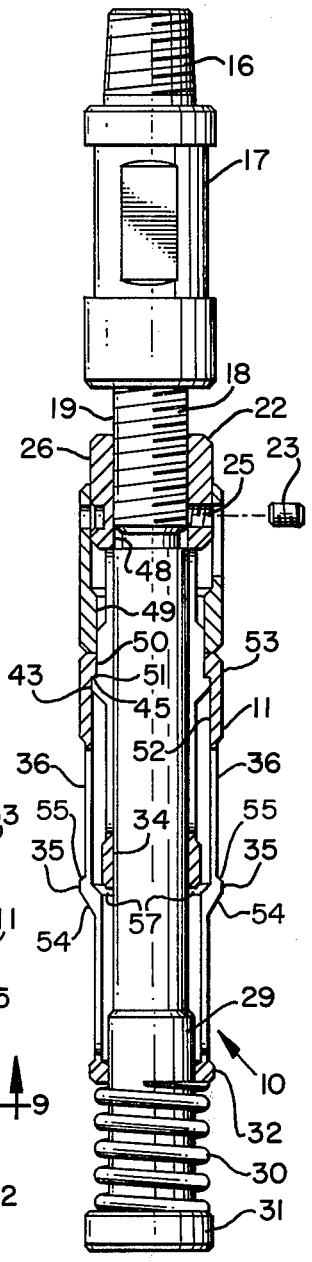
Figure 6:
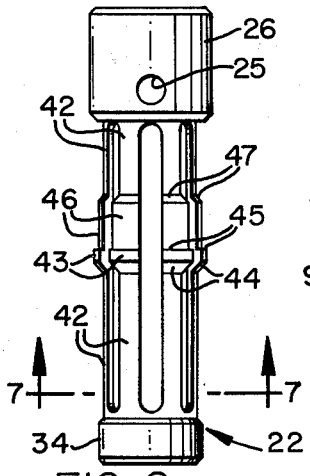
Figure 8:
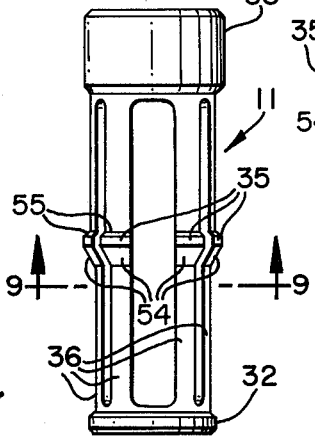
Figure 7:
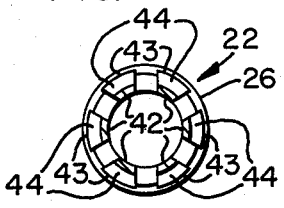
Figure 9:
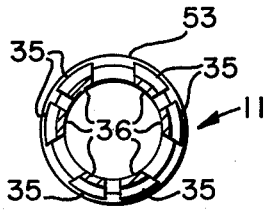

In the drawings:

FIG. 1 represents a side elevation view of applicant's soft set running tool;

FIG. 2, a side elevation view with substantial portions broken away and sectioned to show interior detail;

FIG. 3, a side elevation view of the soft set running tool down well tubing still connected to a tool hanger suspended therefrom that is in set position and connected to a wire line at the top, with well tubing broken away and sectioned along with portions of the running tool to show part position relationships;

FIG. 4, a partial side elevation showing the running tool in the disengagement state and being withdrawn from collet interconnect with a tool hanger;

FIG. 5, a side elevation view with substantial portions broken away and sectioned like FIG. 2, with a set screw loosened (or removed as shown) and a collet lock retainer member threaded up to permit insertion assembly of the running tool into the collet section of a tool hanger to be run;

FIG. 6, a side elevation detail view of the soft set running tool collet lock retainer member;

FIG. 7, a view in section along line 7—7 of FIG. 6 showing further detail of the retainer member of FIG. 6;

FIG. 8, a side elevation detail view of the soft set running tool collet member; and FIG. 9, a view in section along line 9—9 of FIG. 8 showing further detail of the collet member of FIG. 8.

Referring to the drawings:

The soft set running tool 10 of FIGS. 1 and 2 is shown in FIG. 3 in its operational environment still connected to the collet 11 engaging fishing neck 12 of a tool hanger 13 suspended from the running tool 10 that is connected to wire line 14 by a cap member 15 threaded on the upper threaded end 16 of fishing neck member 17. Member 17 is in turn threaded on the top threaded 18 end portion 19 of mandrel 20, with the threads 18 also threaded into threads 21 of collet lock retainer member 22, and is normally locked in position therein by a socket head set screw 23 tightened down on the top end of the mandrel cylindrical body portion 24. Set screw 23 is tightened down through threaded opening 25 in the upper collar 26 of collet lock retainer member 22, and even in the tightened down state the screw 23 extends outwardly into a longitudinally extended slot 27 of sleeve 28 to permit limited relative longitudinal sliding movement thereof on the outside of collar 26. Mandrel 20 is formed with a lower cylindrical portion 29 about which coil spring 30 is positioned and resiliently confined between a bottom mandrel shoulder 31 and the bottom annular ring 32 of collet 11 that is a sliding fit on the mandrel cylindrical portion 29.

Normally the soft set running tool 10 is in the state of FIGS. 1 and 2 with the collet locking retainer ring 34 in lock backing position alignment with locking projections 35 on the spring arms 36 of collet 11. Thus, projections 35 are in locked position with the internal annular beveled shoulder 37 of tool hanger 13 fishing neck 12 such as also shown in FIG. 3 with, however, ring 34 starting to be pulled upward from the locking position toward the non-lock position and locking projection 35 release state of FIG. 4. This is a release transition state with locking projections 35 riding up through the restricted diameter throat 38 of fishing neck 12 for release of the running tool 10 from the tool (or bomb) hanger 13 with locking lugs 39 of hanger 13 locked in extended hanging lock position in annular recess 40 of tubing member 41 and resisting upward movement in engaging the upper recess beveled shoulder as the wire line 14 is exerting sufficient force to start pulling retainer member 22 upward with the mandrel 20 against the resilient force of spring 30.

Another way that the collet lock retainer member 22 may be moved with ring 34 shifted out of lock backing position alignment with locking projections 35 is by loosening set screw 23 and threading the lock retainer member 22 up on the threads 18 of mandrel 20. This is done to facilitate insertion assembly of the running tool 10 into the collet section 12 of a bomb hanger or tool hanger 13 to be run down and position hung in well tubing.

Referring also to FIGS. 6 and 7, the collet lock retainer member 22 is formed with collar 26 at the upper end interconnected by spring arms 42 with collet locking retainer ring 34 at the bottom. The spring arms 42 are provided intermediate their length with outwardly extended retainer projections 43 having downward facing bevel sloped cam surfaces 44, upward facing retainer shoulders 45, raised land portions 46 and upward facing bevel sloped upper cam surfaces 47. Please note also that collar 26 is formed with an inner cylindrical section 48, below internal threads 21, that receives the top of the mandrel cylindrical body portion 24 when the mandrel 20 and retainer member 22 are in the assembled states of FIGS. 1, 2 and 3. Downward facing bevel sloped cam surfaces 44 of projections 43 and spring arms 42 are resiliently deflectable inwardly such as to facilitate easy assembly insertion thereof through reduced diameter bore 49 of sleeve 28 and through the reduced diameter top bore 50 of collet 11 that terminates in downward facing retaining shoulder 51 interconnected with the larger diameter bore 52 of upper collet collar 53. Thus, collet 11 is limited from excessive downward travel and retainer 22 from excessive upward relative travel by limit abutting contact between projection shoulders 45 and shoulder 51. The locking projections 35 on the spring arms 36 of collet 11 are provided with 30° sloped downward facing cam surfaces 54 and 45° sloped upward facing cam surfaces 55 in order that the caming inward resilient riding of the spring arm mounted projections 35 over 30° sloped face 56 of fishing neck 12 be more easily accomplished than caming release riding of projections 35 on 45° sloped face 37 of fishing neck 12. It should be noted further that the spring arms 36 with internediate locking projections 35 are so formed that the insides thereof have upward facing 45° sloped surfaces 57 within the projections 35 extending from a lower lesser spring arm 36 spacing. This provides clearance for collet locking retainer ring 34 when it is raised up from collet locking backing position alignment with locking projections 35 to a non-lock position such as shown in the running tool 10 release state of FIG. 4.

Springs 30 may be selected for different degrees of preload desired from a minimum of at least weight of a tool (or bomb) hanger 13 plus the weight of the equipment suspended by the hanger 13 to higher preloads before upward pulling force exerted through mandrel 20 to the spring 30 would begin compressing the spring while the collet 11 is held in place. In one working example the coil spring 30 selected presented a preload of approximately forty pounds (the equivalent of twice the weight of a temperature and/or pressure bomb plus the weight of the bomb hanger 13). Then with the degree of spring 30 compression attained when retainer ring 34 is raised up out of collet lock backing position alignment with fishing neck locking engagement projections 35 the spring 30 is loaded to approximately 150 pounds at the moment of running tool 10 release. Since different rate springs may be selected for use in the running tool 10 for the running of different tool hanger 13 suspended tool/equipment loads, the running tool 10 must be disassembled and reassembled. Upon reassembly the desired spring 30 is placed on mandrel 20, and then previously assembled collet lock retainer member 22, collet 11 and sleeve 28 are slipped down on the mandrel 20, and then retainer member 22 threads 21 are threaded down on mandrel threads 18 and set screw 23 is tightened down. The fishing neck member 17 is again threaded down on the top of mandrel end portion 19.

It should also be noted that spring arms 36 may be so shaped and sized as to collectively have a spring force resisting inward caming of cam surfaces 55 of projections 35 on fishing neck sloped cam face 37 achieving release from the tool hanger fishing neck 12 upon the retainer ring 34 attaining the non-lock position. Should the collective resistive spring force of spring arms 36 be greater, as translated to upward pulling force exerted on mandrel 20, than the resistive force of coil spring 30 at the end of its compressive tool release state then additional upward pulling force is transmitted from the mandrel 20 through set screw 23 and retainer member 22 via retainer shoulders 45 and collet shoulder 51 to the collet 11. A reasonable balance of release resistive force between coil spring 30 and spring arms 36 results in minimal wear and binding forces being imposed on collet locking retainer ring 34 as it is drawn upward from the locking position to the nonlock position. Further, the additional energy absorbing capacity of spring 30 between the prestressed uncompressed state and the compressed release state represents an ability to absorb a definite amount of shock that may be encountered for example, when a tool hanger with equipment held thereby is being run down a well and the wire line is abruptly stopped by jamming of lowering equipment. This energy absorbing ability may prevent undersired dumping of the hanger and equipment held thereby down the well, through premature running tool release and/or breaking of the wire line and dumping of the running tool also with some wire line 14 down the well.

Whereas this invention is here illustrated and described with respect to a specific embodiment hereof, it should be realized that various changes may be made without departing from essential contributions to the art made by the teachings hereof.

We claim:

1. In a well running tool of the wire line suspended type adapted for running and positioning tool hangers with equipment mounted thereon and with the running tool disengagable from a position locked in the well tool hanger with predetermined release lifting force exerted through the wire line: mandrel means adapted for connection to a wire line and having resilient spring retaining means; collet means slidably mounted on said mandrel means; collet limit position stop means on said mandrel means; prestressed resilient spring means mounted on said mandrel means and confined between said retaining means and said collet means; tool hanger engaging means on said collet means; a locking member movable with said mandrel means between a tool hanger engaging means locking position against resilient force of said spring means to a non-locking position for disengagement of the running tool from a tool hanger; wherein said tool hanger engaging means on said collet means comprises locking projection means positioned on spring arm means of said collet means; said locking projection means has cam surface means and is structured for locked containment in a fishing neck of a tool hanger when maintained in a locked state, and for cam release from said fishing neck when said locking member is moved to a non-locking position with continued release lifting force being exerted through the wire line; said spring arm means comprises a plurality of spring arms extended between an upper collet collar and a bottom collet annular ring that is a sliding fit on said mandrel means; said locking projection means are a plurality of cam ended locking projections mounted on said plurality of spring arms intermediate the ends of said spring arms and projecting radically outward therefrom; and, wherein said plurality of spring arms are shaped with a lesser radial spacing through a portion extending to alignment with and under said locking projections, and with a greater radial spacing through a portion extending from the region of said locking projections toward said upper collet collar.

2. The well running tool of claim 1, wherein said spring means is a coil spring; said resilient spring retaining means is a shoulder on said mandrel means; and said collect means is slidably mounted on said mandrel means for longitudinal movement from a stop limit position against resilient force of the coil spring.

3. The well running tool of claim 2, wherein said coil spring is prestressed to a resilient force level greater than weight sum of the tool hanger and equipment mounted on the tool hanger.

4. The well running tool of claim 2, wherein said tool hanger engaging means on said collet means is projection means shaped to engage a fishing neck structure of a tool hanger and to be subject to cam release from the fishing neck structure when said locking member is moved to said non-locking position.

5. The well running tool of claim 1, wherein said prestressed resilient spring means is prestressed to a resilient force level, in the running tool locking position state, greater than weight sum of the tool hanger and equipment mounted on the tool hanger.

6. The well running tool of claim 5, wherein said prestressed resilient spring means is structural to have an increasing spring rate in movement between the prestressed uncompressed state and the compressed release state.

7. The well running tool of claim 6, wherein said prestressed resilient spring means is structured to absorb a finite amount of shock under abrupt shock loading conditions.

8. The well running tool of claim 1, with substantially a balance of resilient resistive forces between said spring arm means, as translated to lifting force exerted on said mandrel means, and the resistive force of said resilient spring means at a point in the compressive range of said resilient spring means.

9. The well running tool of claim 1, wherein said locking member movable with said mandrel means is movable from a spring arm locking projection backing position in said lesser radial spacing of the spring arms to said non-locking position in said greater radial spacing.

10. The well running tool of claim 9, wherein said locking member is a ring of a retainer member movable into and out of locking backing alignment with said locking projections.

11. The well running tool of claim 10, wherein said retainer member has an upper internally threaded collar threadable down on an upper threaded end of said mandrel means.

12. The well running tool of claim 11, with position locking means on said retainer member for locking the retainer member in its threaded down position.

13. The well running tool of claim 12, with said position locking means comprising a set screw threaded through said retainer member down on said mandrel means.

14. The well running tool of claim 12, with said position locking means loosened said internally threaded collar being threadingly movable through a range from its threaded down and position locked position to a threaded back position with said retainer member ring moved out of locking backing alignment with said locking projections to facilitate assembly of said running tool into fishing neck engagement with a tool hanger.

15. The well running tool of claim 11, wherein a fishing neck member is threaded to the top of said upper threaded end of said mandrel means.

16. The well running tool of claim 10, wherein said locking projections have both upper and lower cam surface means.

17. The well running tool of claim 3, wherein said upper cam surface means is a steeper cam surface than the cam surface of said lower cam surface means.

* * * * *